US008169396B2

(12) United States Patent
Chiang et al.

(10) Patent No.: US 8,169,396 B2
(45) Date of Patent: May 1, 2012

(54) LIQUID CRYSTAL DISPLAY DEVICE WITH REDUCED POWER CONSUMPTION AND DRIVING METHOD THEREOF

(75) Inventors: Cheng-Lung Chiang, Tainan (TW); Ming-Cheng Chiu, Tainan (TW)

(73) Assignee: Himax Technologies, Inc. (TW)

( * ) Notice: Subject to any disclaimer, the term of this patent is extended or adjusted under 35 U.S.C. 154(b) by 693 days.

(21) Appl. No.: 12/325,891

(22) Filed: Dec. 1, 2008

(65) Prior Publication Data

US 2010/0134400 A1 Jun. 3, 2010

(51) Int. Cl.
*G09G 3/36* (2006.01)

(52) U.S. Cl. ..... 345/99

(58) Field of Classification Search ..... None
See application file for complete search history.

(56) References Cited

U.S. PATENT DOCUMENTS

2008/0117235 A1* 5/2008 Morita ..... 345/690

* cited by examiner

*Primary Examiner* — Daniell L Negron
(74) *Attorney, Agent, or Firm* — Baker & McKenzie LLP

(57) ABSTRACT

A liquid crystal display (LCD) device with reduced power consumption is provided with a plurality of data lines, a plurality of gate lines, and at least one demultiplexer. Each demultiplexer can comprise a plurality of switches respectively connected to the corresponding data lines and controlled by a plurality of clock signals and configured to receive an image signal, and selectively output the image signal to one of the data lines via the switches. During a driving period, one of the gate lines can be asserted, and the switches can be turned on simultaneously, then only the first one of the switches remains turned on to transmit the image signal to the corresponding data line, and then the first one of the switches are turned off and the other switches is sequentially turned on one at a time to transmit the image signal to the corresponding data lines.

14 Claims, 2 Drawing Sheets

LIQUID CRYSTAL DISPLAY DEVICE WITH REDUCED POWER CONSUMPTION AND DRIVING METHOD THEREOF

BACKGROUND

1. Technical Field

The embodiments described herein relate to a display device and more particularly to a low temperature polysilicon (LTPS) display device with an enhanced timing control to reduce power consumption.

2. Description of the Related Art

Recently, a variety of electronic display devices and products have undergone significant changes due to the rapid development of semiconductor devices and user interfaces of the devices. Liquid crystal display (LCD) devices, for example, thin film transistor (TFT) LCD devices, have quickly become the mainstream of display devices. In general, the conventional thin film transistor (TFT) may be classified as either an a-Si (Amorphous Silicon) thin film transistor (TFT) or a polysilicon thin film transistor (TFT). A-Si and LTPS are both technologies for integrating TFT onto a glass substrate. The technology of low temperature polysilicon (LTPS) is different from the technology of conventional a-Si. The most obvious differences being the electrical characteristics and complexity of processing. In low temperature polysilicon (LTPS) technology, electron mobility can be enhanced to more than 200 $cm^2$/V-sec. Therefore, the size of the thin film transistor (TFT) can be minimized, the aperture ratio of the display can be enhanced, and the power consumption can be reduced.

In general, for amorphous silicon TFT display devices, each data channel drives only one pixel. In contrast, for LTPS TFT display devices, they are provided with multiplexers for data drivers, so that one data channel can drive more than one pixel at a time. However, the loading for LTPS TFT display devices is mainly in the multiplexers and panel pixels following the multiplexers. The timing control of the multiplexers will play a crucial rule in any improvements made to the power consumption of the LTPS TFT display device. An adaptive LTPS timing control for enhanced power saving efficiency is therefore needed.

SUMMARY

A display device and a driving method thereof with improved demultiplexer timing control and hence reduced power consumption, are described herein.

According to one aspect, a liquid crystal display (LCD) device can comprise a plurality of data lines, a plurality of gate lines, and at least one demultiplexer. Each of the demultiplexer can comprise a plurality of switches respectively connected to the corresponding data lines and controlled by a plurality of clock signals, receive an image signal, and selectively output the image signal to one of the data lines via the switches. During a driving period, one of the gate lines can be asserted, and the switches can be turned on simultaneously, while only a first one of the switches remains turned on to transmit the image signal to the corresponding data line. Then the first one of the switches can be turned off and the other switches can be sequentially turned on one at a time to transmit the image signal to the corresponding data lines.

According to another aspect, a driving method of a liquid crystal display (LCD) device is disclosed. The LCD device can include data lines, gate lines, and a demultiplexer. The demultiplexer can have switches respectively connected to the corresponding data lines. The demultiplexer can receive an image signal and selectively output the image signal to one of the data lines via the switches. The driving method can comprise the steps: asserting one of the gate lines, simultaneously turning on the switches, maintaining only the first one of the switches turned on to transmit the image signal to the corresponding data line, and then turning off the first one of the switches and sequentially turning on the other switches one at a time to transmit the image signal to the corresponding data lines.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
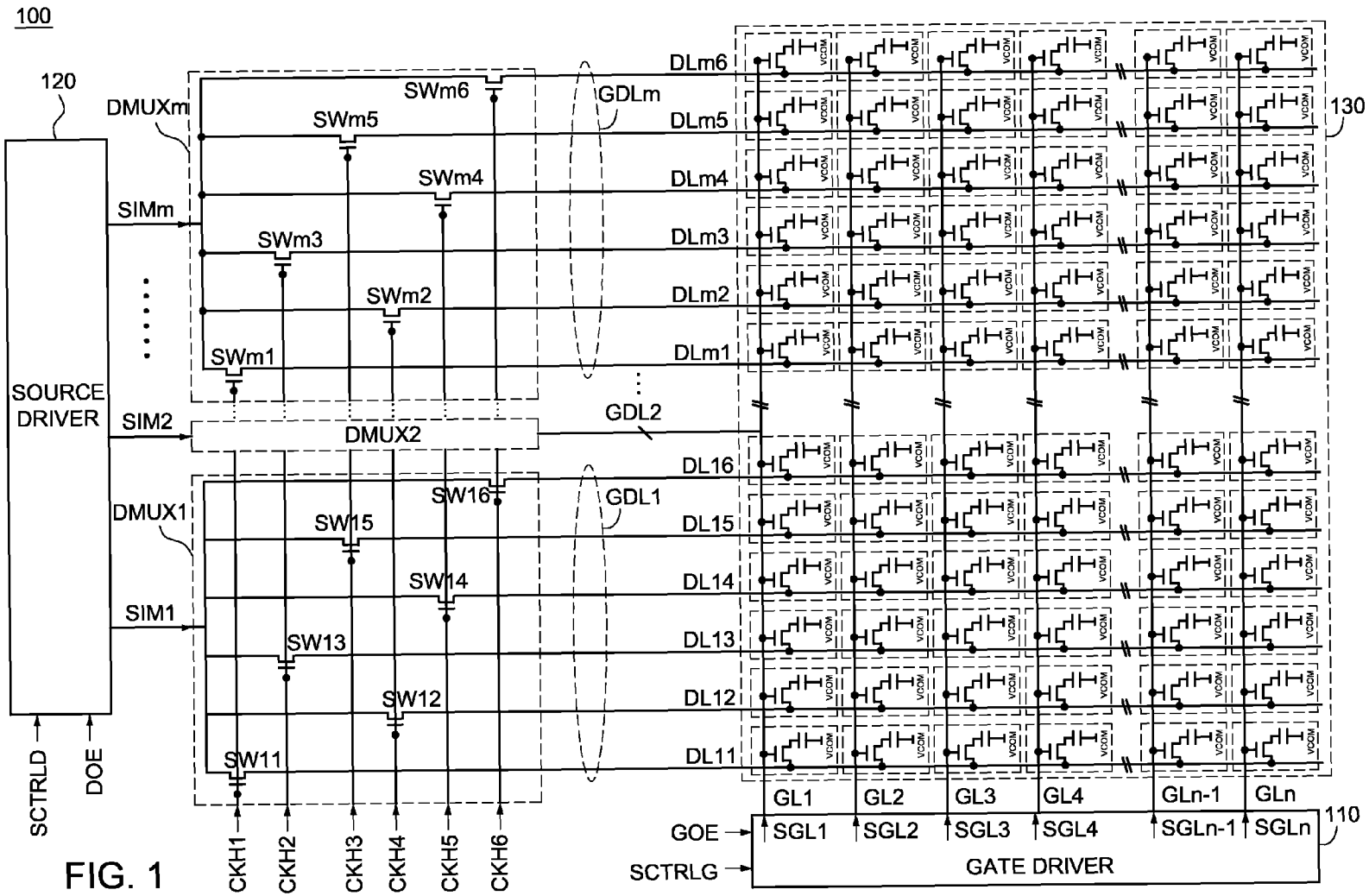
FIG. 1 is a block diagram of a display device in accordance with one embodiment.

FIG. 1 is a block diagram of a display device in accordance with an embodiment. As shown, the display device 100, for example, a low temperature polysilicon (LTPS) LCD device, can comprise a gate driver 110, a data driver 120, a plurality of demultiplexers DMUX1, DMUX2, . . . DMUXm, and an LCD panel 130 having a plurality of pixel cells arranged at intersections between a plurality of gate lines GL1, GL2, . . . , GLn and a plurality of data line groups GDL1, GDL2, . . . , GDLm (where m and n are non-zero integers). The LCD panel 130, for example, can be a low temperature poly-silicon (LTPS) panel. Each of the pixel cells in the LCD panel 130 can comprise a thin film transistor (TFT) and a capacitor coupled to a reference voltage $V_{com}$. The data line group GDLi (where i is a non-zero integer between 1 and m) can comprise a plurality of data lines DLi1, DLi2, . . . , DLip (where p is a non-zero integer and p=6 in the exemplary embodiment). It should be noted, however, that the data line groups GDL1-GDLm can comprise different numbers of data lines in other embodiments.

The gate driver 110, connected to the gate lines GL1, GL2, . . . , GLn, can be configured to make an on/off control of the TFT's arranged on the LCD panel 130 to allow image signals from the data driver 120 to be applied to each pixel. The gate driver 110, in response to a gate control signal 'SCTRLG' from a timing controller (not shown), can sequentially apply gate driving signals 'SGL1', 'SGL2', . . . , 'SGLn' respectively to the gate lines GL1, GL2, . . . , GLn to turn on the TFTs in the pixels connected to the corresponding gate lines. Additionally, the gate driver 110 can receive a gate output enable signal 'GOE' from the timing controller. The gate output enable signal 'GOE' can be a signal for controlling the output of the gate driver 110, that is, controlling output of the gate driving signals 'SGL1', 'SGL2', . . . , 'SGLn' from the gate driver 110. Specifically, when the gate output enable signal 'GOE' assumes a first state (e.g., high state), the gate driver 110 can be enabled to provide the gate driving signals 'SGL1', 'SGL2', . . . , 'SGLn', so the gate lines GL1 to GLn are respectively driven to the levels of the gate driving signals 'SGL1', 'SGL2', . . . , 'SGLn'; and when the gate output enable signal 'GOE' assumes a second state (e.g., low state), the gate driver 110 can terminate providing the gate driving signals 'SGL1', 'SGL2', . . . , 'SGLn' and can force the gate lines GL1 to GLn at low states.

The data driver 120 can be configured to supply image signals to the data line groups GDL1, GDL2, . . . , GDLm respectively through the demultiplexers DMUX1-DMUXm. The data driver 120 can receive a data control signal 'SCTRLD' including video data from the timing controller, converts it to image signals 'SIM1', 'SIM2', . . . , 'SIMm', and supplies the image signals 'SIM1'-'SIMm' respectively to the demultiplexers DMUX1-DMUXm.

The demultiplexer DMUXj, for example, formed on the low temperature polysilicon panel 130, can comprise a plurality of switches SWj1, SWj2, . . . , SWjp. The switches SWj1, SWj2, . . . , SWjp can be respectively connected to the corresponding data lines DLj1, DLj2, . . . , DLjp and controlled by a plurality of clock signals 'CKH1', 'CKH2', . . . , 'CKHp' (where j is any integer between 1 and m). The clock signals 'CKH1', 'CKH2', . . . , 'CKHp' can be signals for controlling the transmission of the image signal 'SIMj' through the switches SWj1, SWj2, . . . , SWjp to the data lines DLj1, DLj2, . . . , DLjp. Specifically, when the clock signal 'CKHk' ($1 \leqq k \leqq p$) is at a first state (e.g., high state), the switch SWjk is turned on, and the DMUXj transmits the image signal 'SIMj' to the data line DLjk; and conversely, when the clock signal 'CKHk' is at a second state (e.g., low state), the switch SWjk is turned off, and the DMUXj stops transmitting the image signal 'SIMj' to the data line DLjk. Because the TFT of each pixel connected to the gate line GLj is turned on when a high level of corresponding gate driving signal 'SGLj' can be applied to the gate line GLj, the clock signals 'CKH1'-'CKHp' can be sequentially set high during the high state of the gate driving signal 'SGLj' to allow the image signal 'SIMj' to be sequentially provided to the data lines DLj1, DLj2, . . . , DLjp.

Additionally, the data driver 120 can receive a data output enable signal 'DOE' from the timing controller. The data output enable signal 'DOE' is a prompt for when to supply the pixel with data. In other words, the data output enable signal 'DOE' is a signal that can be used to control the output of the image signals 'SIM1'-'SIMm' from data driver 120. Specifically, when the data output enable signal 'DOE' is in a first state (e.g., high state), the data driver 120 is enabled to output the image signals 'SIM1'-'SIMm' so that the inputs of the demultiplexers DMUX1-DMUXm are respectively pulled to the levels of the image signals 'SIM1'-'SIMm'; and when the data output enable signal 'DOE' is in a second state (e.g., low state), the data driver 120 terminates outputting the image signals 'SIM1'-'SIMm'.

Figure 2:
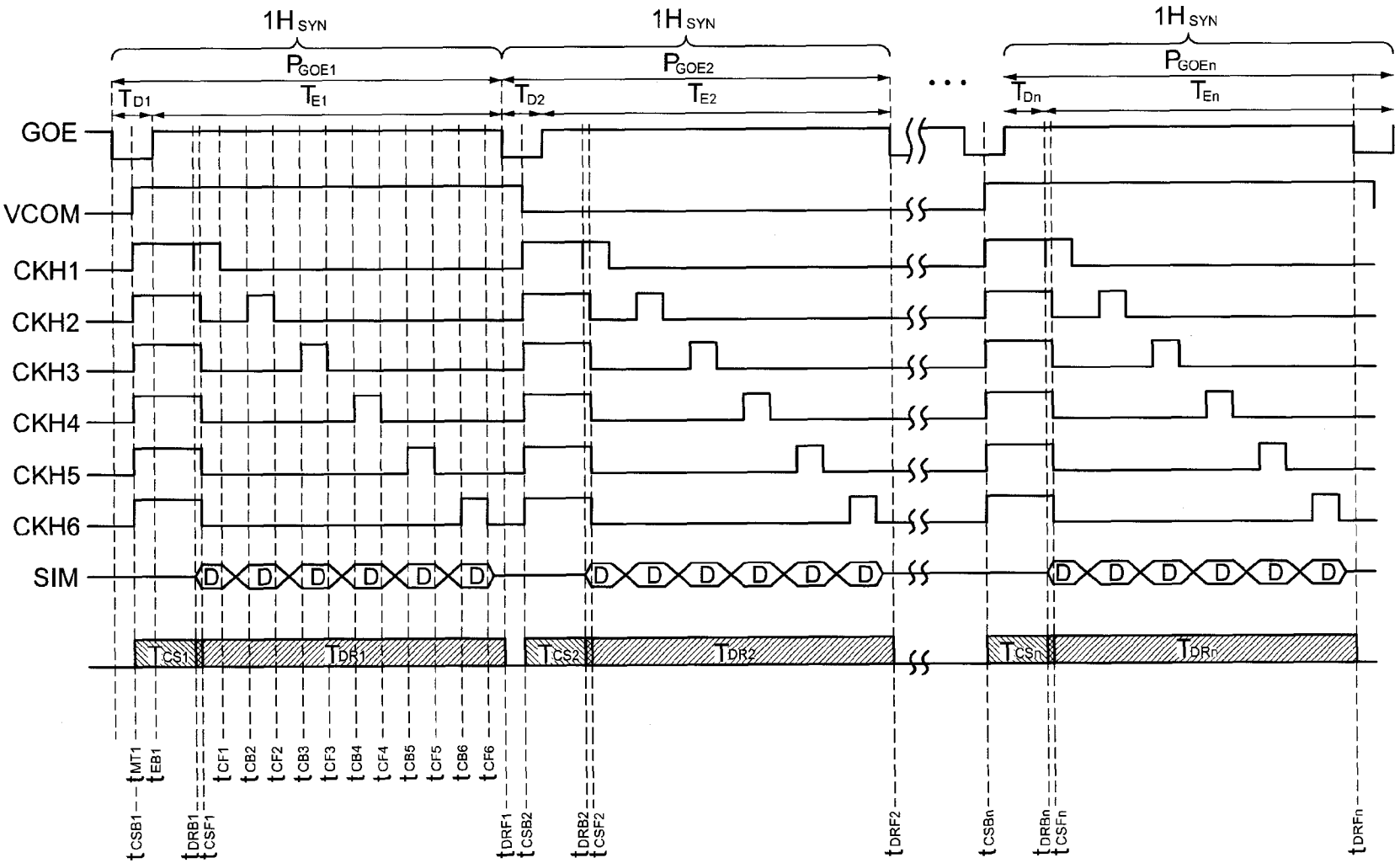
FIG. 2 is a timing diagram showing waveforms of typical signals of the display device in FIG. 1 in accordance with one embodiment.

FIG. 2 is a timing diagram showing waveforms of typical signals of the display device 100 in FIG. 1 in accordance with an embodiment, wherein the LCD panel 130 can be driven by a line inversion (also referred to as gate inversion or row inversion) method. Referring to FIG. 2, the gate output enable signal 'GOE' has period $P_{GOEi}$s each equal to one horizontal synchronizing period $H_{SYN}$. Each period $P_{GOEi}$ can consist of an enable interval $T_{Ei}$ and a disable interval $T_{Di}$ ($1 \leqq i \leqq m$). During the enable intervals $T_{E1}, T_{E2}, \ldots, T_{En}$, the gate driving signals 'SGL1'-'SGLn' can be sequentially turned on high to turn on the TFTs connected to the corresponding gate lines GL1-GLn; and during the disable intervals $T_{D1}$-$T_{Dn}$, all the gate driving signals 'SGL1'-'SGLn' can be pulled low, turning off the TFTs.

Because the LCD panel 130 is driven by a line inversion method, the polarity of the reference voltage $V_{COM}$ can be toggled every one horizontal synchronizing period $H_{SYN}$. As shown, for example, the polarity of the voltage $V_{COM}$ can be changed at time $t_{MT1}$ during the first disable period $T_{D1}$ of the gate output enable signal 'GOE'.

At time $t_{CSB1}$ during the disable interval $T_{D1}$, a starting point of a charge-sharing period $T_{CS1}$, all the clock signals 'CKH1'-'CKHp' can be simultaneously set to a high level, thereby electrically connecting the data lines DL11-DL1*p*, wherein the toggling time $t_{MT1}$ is preferably set equal to the starting time $t_{CS1}$. At the same time, the data output enable signal 'DOE' can be set to a low level, so the data driver 120 does not provide the image signals. As a result, the data lines DL11-DL16 can mutually share remaining charges previously (that is, before $t_{CSB1}$) stored therein and reach an average level of the previous voltages of the data lines DL11-DL16.

Afterwards, at time $t_{EB1}$, the gate output enable signal 'GOE' enters the first enable interval $T_{E1}$, and then the gate driver 110 starts to assert the gate line GL1 to high.

Afterwards, at time $t_{DRB1}$, a starting point of a driving period $T_{DR1}$, the data output enable signal 'DOE' transitions from low to high, enabling the image signal 'SIM1' to be supplied to the demultiplexer DMUX1. Meanwhile, the clock signals 'CKH1'-'CKH6' can still all be maintained at high states, so that the charge sharing continues. As a result, the data lines DL11-DL16 connected to the demultiplexer DMUX1 can be driven towards the level of the image signal 'SIM1'.

Shortly afterwards, at time $t_{CSF1}$, an ending point of the charge-sharing period $T_{CS1}$, all the clock signals except the first one, i.e. 'CKH2'-'CKH6', can simultaneously transition from high to low, stopping the transmission of the image signal 'SIM1' from the data driver through the demultiplexer DMUX1 to the data lines DL12-DL16, which terminates the charge sharing.

At the same time, the data output enable signal 'DOE' can be maintained at the high state, so the image signal 'SIM1' can be output. As a result, the image signal 'SIM1' can be transmitted through the first switch SWj1 (that is turned on by the high level setting of first clock signal 'CKH1') to the first data line DL11 until time $t_{CF1}$ (when the first clock signal 'CKH1' is turned to low).

Afterwards, at time $t_{CB2}$, the second clock signal 'CKH2' can be asserted to high and maintained until time $t_{CF2}$ when it transitions to low again. During the interval between time $t_{CB2}$ and $t_{CF2}$, the image signal 'SIM1' can be transmitted only to the second data line DL12. Afterwards, during time intervals $t_{CB3}$-$t_{CF3}$, $t_{CB4}$-$t_{CF4}$, . . . , $t_{CB6}$-$t_{CF6}$, the clock signals 'CKH3', 'CKH4', . . . , 'CKH6' can be sequentially turned high such that the image signal SIM1 can be transmitted sequentially to the data line DL13, DL14, . . . , DL16. As a result, one frame line corresponding to the first gate line GL1 is displayed.

Similar processes are realized during the enable intervals $T_{E2}$-$T_{En}$, during which the gate lines GL2-GLn can be driven high respectively and are thus omitted here for brevity.

One important feature of the embodiment is that the charge-sharing period $T_{CSi}$ and the driving period $T_{DRi}$; can be merged together. In the embodiment, the charge-sharing period $T_{CSi}$ and the driving period $T_{DRi}$; can be overlapped between the starting time $t_{DRBi}$ of the driving period $T_{DRi}$; and the ending time $t_{CSFi}$ of the charge-sharing period $T_{CSi}$. The times $t_{DRBi}$ and $t_{CSFi}$ can be set close to each other to prevent the data lines DLi2-DLip from being driven too much by the image signal 'SIMi' in the charge sharing period $T_{CSi}$. In other embodiments, the times $t_{DRBi}$ and $t_{CSFi}$ can be set at the same point.

It is noted that in the embodiment, the reference voltage $V_{COM}$ can be toggled every horizontal synchronizing period $H_{SYN}$ to realize line inversion ($t_{MTi}=t_{CSBi}$). However, the invention is not limited thereto. For example, in another embodiment with fixed polarity of the reference voltage $V_{COM}$, the line inversion can be realized by toggling the image signals 'SIM1'-'SIMm' instead. In such an embodiment, the duration when all the clock signals are turned high, namely the charge-sharing period $T_{CSi}$, can still be started simultaneously with the toggling time of the image signals 'SIM1'-'SIMm' every horizontal synchronizing period $H_{SYN}$.

It is also noted that in the embodiment using the line inversion method, the reference voltage $V_{COM}$ can be toggled every horizontal synchronizing period $H_{SYN}$. However, the embodiments described herein are not limited to just the line inversion method, and can be applied to the frame inversion method, the data inversion (also referred to as column inversion or source inversion) method, the dot inversion method, and other comparabale driving methods. In the other driving methods, the polarity of the reference voltage $V_{COM}$ is not necessarily switched every horizontal synchronizing period $H_{SYN}$. In these embodiment, the charge-sharing period $T_{CSi}$, or the duration when all the clock signals are turned high, can still be started during the disable interval $T_{Di}$ of the gate output enable signal GOE, that is, before any of the gate lines is driven high.

For a display device without implementations of demultiplexers, an image signal 'SIMi' has to be continuously provided to a corresponding data line DLi during the enable interval of a horizontal synchronizing period. However, in a display device with the demultiplexers DMUX1-DMUXp, each image signal can be transmitted sequentially to the data lines DLi1-DLip during the enable interval of a horizontal synchronizing period. In other words, each data line is provided with the image signal 'SIMi' only for a part of the horizontal synchronizing period, or 1/p times the driving period $T_{DRi}$; in FIG. 2 ($1 \leqq i \leqq m$), which is much shorter than that the time without the demultiplexers. The power consumption of the display device can therefore be reduced.

Additionally, with all of the clock signals simultaneously turned high in the charge-sharing period, the power consumption can also be further reduced. That is, the level of each data line can be pulled to the average level of the previous voltages due to charge sharing before being pulled to the level of the image signal during the driving period. The voltage difference on each data line required to be driven during the driving period is thus lower than that without charge sharing, and the power consumption can be reduced.

Additionally, because the charge-sharing period and the driving period are merged rather than separated, that is, the charge-sharing period is extended to reach the driving period, the charge-sharing period is longer compared to that separate from the driving period. Consequently, the charge-recycling can be realized more completely and the power consumption can be further reduced. Also, due to the merging, the first clock signal can be continuously turned high from the charge-sharing period to the driving period, and the driving mechanism for the first clock signal can be simplified.

While certain embodiments have been described above, it will be understood that the embodiments described are by way of example only. Accordingly, the apparatus and methods described herein should not be limited based on the described embodiments. Rather, the apparatus and methods described herein should only be limited in light of the claims that follow when taken in conjunction with the above description and accompanying drawings. Therefore, the scope of the appended claims should be accorded the broadest interpretation so as to encompass various modifications and similar arrangements [as would be apparent to those skilled in the art].

What is claimed is:

1. A liquid crystal display (LCD) device, comprising:

a plurality of data lines;

a plurality of gate lines;

an array of pixel cells, each of the pixel cells being coupled with one of the gate lines and one of the data lines;

a gate driver coupled with the plurality of gate lines, the gate driver being configured to receive a gate output enable signal having a first voltage level and a second voltage level, wherein the gate output enable signal is set to the first voltage level to unselect all of the gate lines, and the gate output enable signal is set to the second voltage level to have the gate driver select one of the gate lines;

a data driver configured to output an image signal; and a demultiplexer comprising a plurality of switches respectively connected to the data lines and respectively controlled by a plurality of clock signals, the demultiplexer configured to transmit the image signal from the data driver selectively to the data lines via the switches, each of the clock signals being set to a third voltage level to turn on the associated switch, and to a fourth voltage level to turn off the associated switch;

wherein all of the switches are configured to turn on as the clock signals are concurrently set to the third voltage level meanwhile the gate output enable signal is set to the first voltage level for sharing charges among the data lines;

while all of the clock signals are concurrently set to the third voltage level, the gate output enable signal is changed from the first voltage level to the second voltage level to have the gate driver select one of the gate lines; and while the gate output enable signal is continuously kept at the second voltage level, the clock signals are sequentially set to the third voltage level one at a time to turn on the switches one at a time to apply the image signal to each of the data lines.

2. The LCD device of claim 1, wherein each of the pixel cells comprises a capacitor coupled to a reference voltage, and the reference voltage is toggled substantially concurrent to a raising edge of all of the clock signals to the third voltage level.

3. The LCD device of claim 1, wherein the LCD device is a low temperature polysilicon (LTPS) device.

4. The LCD device of claim 1, wherein the demultiplexer is formed on a low temperature polysilicon panel.

5. The LCD device of claim 1, wherein the data driver is configured to receive a data output enable signal having a fifth voltage level and a sixth voltage level, the data output enable signal being set to the fifth voltage level to disable the output of the image signal from the data driver, and to the sixth voltage level to have the data driver output the image signal.

6. The LCD device of claim 5, wherein while all of the clock signals are kept at the third voltage level and the gate output enable signal is concurrently kept at the second voltage level, the data output enable signal is changed from the fifth voltage level to the sixth voltage level to have the data driver output the image signal to the demultiplexer.

7. The LCD device of claim 6, wherein while the data output enable signal is kept at the sixth voltage level and the gate output enable signal is concurrently kept at the second voltage level, one of the control signal is kept at the third voltage level whereas all of the other control signals are concurrently set to the fourth voltage level, whereby only one of the switches is kept turned on to apply the image signal through the data line connected therewith.

8. A driving method of a liquid crystal display (LCD) device, the LCD device includes data lines, gate lines, an array of pixel cells each respectively coupled with one of the gate lines and one of the data lines, a gate driver connected with the gate lines, a data driver configured to output an image signal, and a demultiplexer having switches respectively connected to the data lines, the demultiplexer configured to transmit the image signal selectively to the data lines via the switches, the driving method comprising:

providing a gate output enable signal to the gate driver, the gate output enable signal having a first voltage level and a second voltage level, wherein the gate output enable signal is set to the first voltage level to unselect all of the gate lines, and the gate output enable signal is set to the second voltage level to have the gate driver select one of the gate lines;

providing a plurality of control signals to respectively control the switches, wherein each of the clock signals is set to a third voltage level to turn on the associated switch, and to a fourth voltage level to turn off the associated switch;

concurrently setting all of the clock signals to the third voltage level and the gate output enable signal to the first voltage level to share charges among the data lines;

while all of the clock signals are kept at the third voltage level, changing the gate output enable signal from the first voltage level to the second voltage level to have the gate driver select one of the gate lines; and while the gate output enable signal is kept at the second voltage level, having the clock signals set to the third voltage level one at a time to turn on the switches one at a time to apply the image signal to each of the data lines.

9. The driving method of claim 8, wherein each of the pixel cells comprises a capacitor coupled to a reference voltage, and the driving method further comprises a step of toggling the reference voltage substantially concurrent to a raising edge of all of the clock signals to the third voltage level.

10. The driving method of claim 8, wherein the LCD device is a low temperature polysilicon (LTPS) device.

11. The driving method of claim 8, further comprising providing a data output enable signal to the data driver, wherein the data output enable signal has a fifth voltage level and a sixth voltage level, the data output enable signal being set to the fifth voltage level to disable the output of the image signal from the data driver, and to the sixth voltage level to have the data driver output the image signal.

12. The driving method of claim 11, wherein while all of the clock signals are kept at the third voltage level and the gate output enable signal is concurrently kept at the second voltage level, the driving method comprises changing the data output enable signal from the fifth voltage level to the sixth voltage level to have the data driver output the image signal to the demultiplexer.

13. The driving method of claim 12, wherein while the data output enable signal is kept at the sixth voltage level and the gate output enable signal is concurrently kept at the second voltage level, the driving method comprises keeping one of the control signal at the third voltage level and concurrently setting all of the other control signals to the fourth voltage level, whereby only one of the switches is kept turned on to apply the image signal through the data line connected therewith.

14. A driving method of a liquid crystal display (LCD) device, the LCD device including data lines, gate lines, an array of pixel cells each respectively coupled with one of the gate lines and one of the data lines, a gate driver connected with the gate lines, a data driver configured to output an image signal, and a demultiplexer having switches respectively connected to the data lines, the demultiplexer configured to selectively transmit the image signal to the data lines via the switches, the driving method comprising:

providing a gate output enable signal to the gate driver, the gate output enable signal having a first voltage level and a second voltage level, wherein the gate output enable signal is set to the first voltage level to unselect all of the gate lines, and the gate output enable signal is set to the second voltage level to have the gate driver select one of the gate lines;

providing a plurality of control signals to respectively control the switches, wherein each of the clock signals is set to a third voltage level to turn on the associated switch, and to a fourth voltage level to turn off the associated switch;

providing a data output enable signal to the data driver, wherein the data output enable signal has a fifth voltage level and a sixth voltage level, the data output enable signal being set to the fifth voltage level to disable the output of the image signal from the data driver, and to the sixth voltage level to have the data driver output the image signal;

concurrently setting all of the clock signals to the third voltage level and the gate output enable signal to the first voltage level to share charges among the data lines;

while all of the clock signals are kept at the third voltage level, changing the gate output enable signal from the first voltage level to the second voltage level to have the gate driver select one of the gate lines;

while all of the clock signals are kept at the third voltage level and the gate output enable signal is concurrently kept at the second voltage level, changing the data output enable signal from the fifth voltage level to the sixth voltage level to have the data driver output the image signal to the demultiplexer;

while the data output enable signal is kept at the sixth voltage level and the gate output enable signal is concurrently kept at the second voltage level, keeping one of the control signal at the third voltage level and concurrently setting all of the other control signals to the fourth voltage level, whereby only one of the switches is kept turned on to apply the image signal through the data line connected therewith; and while the gate output enable signal is kept at the second voltage level to select one of the gate lines, having the clock signals set to the third voltage level one at a time to turn on the switches one at a time to apply the image signal to each of the data lines.

* * * * *